US006802501B2

(12) United States Patent
Boss et al.

(10) Patent No.: US 6,802,501 B2
(45) **Date of Patent: *Oct. 12, 2004**

(54) POST PRINT FINISHING DEVICE WITH IMAGING MATERIAL BINDER

(75) Inventors: Roland Boss, Jalisco, NM (US); Israel Cruz Ruiz, Jalisco, NM (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/600,863

(22) Filed: Jun. 20, 2003

(65) Prior Publication Data

US 2004/0028506 A1 Feb. 12, 2004

Related U.S. Application Data

(63) Continuation of application No. 09/925,902, filed on Aug. 9, 2001, now Pat. No. 6,601,840.

(51) Int. Cl.[7] ..... B42C 13/00

(52) U.S. Cl. ..... 270/58.07; 270/58.08; 270/58.11; 412/8; 412/37; 412/900

(58) Field of Search ..... 270/58.07, 58.08, 270/58.09, 58.1, 58.11, 58.12, 58.13, 58.14, 58.15, 58.16, 58.17; 412/8, 37, 900; 399/409, 410

(56) References Cited

U.S. PATENT DOCUMENTS

| | | | | | |
|---|---|---|---|---|---|
| 3,775,782 | A | | 12/1973 | Rice et al. | |
| 3,788,921 | A | | 1/1974 | Polit et al. | |
| 3,793,016 | A | * | 2/1974 | Eichorn | 430/124 |
| 3,794,550 | A | | 2/1974 | Taillie | |
| 4,016,021 | A | | 4/1977 | La Fleur | |
| 4,343,673 | A | | 8/1982 | Smith, Jr. et al. | |
| 4,826,475 | A | | 5/1989 | Eweryd | |
| 5,014,092 | A | | 5/1991 | Kubo et al. | |
| 5,121,911 | A | * | 6/1992 | Yamazaki et al. | 270/58.13 |
| 5,160,234 | A | | 11/1992 | Lazar | |
| 5,213,560 | A | | 5/1993 | Crowley | |
| 5,240,362 | A | | 8/1993 | Nakayama et al. | |
| 5,257,081 | A | | 10/1993 | Kato et al. | |
| 5,288,192 | A | | 2/1994 | Ito et al. | |
| 5,328,438 | A | | 7/1994 | Crowley | |
| 5,456,646 | A | | 10/1995 | Crowley | |
| 5,531,429 | A | | 7/1996 | Clark | |
| 5,582,570 | A | | 12/1996 | Crowley | |
| 6,042,098 | A | * | 3/2000 | Kubota et al. | 270/58.02 |
| 6,170,100 | B1 | | 1/2001 | Le Gette et al. | |
| 6,173,671 | B1 | | 1/2001 | Casull | |
| 6,213,456 | B1 | | 4/2001 | Hirano et al. | |
| 6,457,705 | B2 | | 10/2002 | Nanba et al. | |
| 6,485,344 | B2 | | 11/2002 | Arias | |
| 6,601,840 | B2 | * | 8/2003 | Boss et al. | 270/58.08 |

* cited by examiner

*Primary Examiner*—Patrick Mackey

(57) ABSTRACT

A post print finishing device that incorporates an imaging material binder into the post print handling and finishing functions. In one exemplary embodiment, the finishing device includes a flipper module, an accumulator module and a binder module. The binder module binds sheets together by reactivating imaging material applied to binding regions on the sheets by a printing device. The flipper module receives a sheet leading edge first and discharges the sheet trailing edge first. That is to say, the flipper module flips the sheet before discharging the sheet for further processing. The accumulator module stacks the sheets, presents the sheets to the binder for binding and then discharges the bound stack to the output bin.

7 Claims, 11 Drawing Sheets

POST PRINT FINISHING DEVICE WITH IMAGING MATERIAL BINDER

CROSS REFERENCE TO RELATED APPLICATION

This is a continuation of application Ser. No. 09/925,902 filed Aug. 9, 2001 now U.S. Pat. No. 6,601,840, titled Post Print Finishing Device With Imaging Material Binder.

FIELD OF THE INVENTION

The present invention is directed to a post print finishing device in which imaging material is used to bind a printed documented.

BACKGROUND OF THE INVENTION

Current devices and methods for printing and binding media sheets involve printing the desired document on a plurality of media sheets, assembling the media sheets into a stack, and separately stapling, clamping, gluing and/or sewing the stack. In addition to imaging material used to print the document, each of these binding methods require separate binding materials, increasing the cost and complexity of binding. Techniques for binding media sheets using imaging material are known in the art. These techniques generally involve applying imaging material such as toner to defined binding regions on multiple sheets, assembling the media sheets into a stack, and reactivating the imaging material, causing the media sheets to adhere to one another.

The present invention was developed to integrate an imaging material binder into a post print finishing device such as the stapler/stacker devices commonly used with middle to high end printers and copiers. The modular implementation shown in the drawings and detailed below was developed for use in the Hewlett-Packard Company model C8085A stapler/stacker with the imaging material binder module replacing the stapler module. Various techniques and structural configurations for binding documents using imaging material are described in U.S. patent application Ser. No. 09/320,060, filed May 26, 1999 titled Binding Sheet Media Using Imaging Material, Ser. No. 09/482,124, filed Jan. 11, 2000 titled Apparatus and Method For Binding Sheet Media, and Ser. No. 09/866,017, filed May 24, 2001 titled Apparatus and Method for Binding Sheet Media, all of which are incorporated herein by reference in their entirety.

When imaging material binding is used, each sheet of paper or other print media includes imaging material, such as toner, applied to one or more selected binding regions in addition to the print image applied to each sheet. The binding regions are usually located along one edge of the media sheet on one or both sides. All of the imaging material applied to the sheet is activated as part of the print process. The imaging material applied to the binding region(s) is reactivated in the binder to bind the multiple sheets of a document together. The bound document may be formed by reactivating the imaging material in a stack of sheets in the document at the same time or by individually binding each sheet one after another to the stack. The strength of the inter-sheet bond is a function of the type, area, density, and degree of reactivation of the imaging material applied to the binding region of each sheet. By varying these parameters the inter-sheet bond can be made very strong to firmly bind the document or less strong to allow easy separation. When the imaging material is toner, such as that used in laser printers, the imaging material will usually be reactivated by applying heat and pressure as in the exemplary embodiment of the invention detailed below. Other imaging materials and reactivation techniques may also be used, such as those described in the '060 application.

SUMMARY OF THE INVENTION

Accordingly, the present invention is directed to a post print finishing device that incorporates an imaging material binder into the post print handling and finishing functions. In one exemplary embodiment of the invention, the finishing device includes a flipper module, an accumulator module and a binder module. The binder module binds sheets together by reactivating imaging material applied to binding regions on the sheets by a printing device. The flipper module receives a sheet leading edge first and discharges the sheet trailing edge first. That is to say, the flipper module flips the sheet before discharging the sheet for further processing. The accumulator module stacks the sheets, presents the sheets to the binder for binding and then discharges the bound stack to the output bin.

DESCRIPTION OF THE DRAWINGS

FIG. 3 shows a sheet routed to the upper/single sheet output bin. FIGS. 4–7 show a sheet routed to the stack of sheets in the accumulator in preparation for binding. FIGS. 8–10 show the stack routed to the binder, bound and then discharged to the lower/stacker output bin.

DETAILED DESCRIPTION OF THE INVENTION

The invention will be described with reference to the printer 10 and attached stacker 12 shown in FIG. 1. The invention may be implemented in any document production system in which it is necessary or desirable to use an imaging material binder. Printer 10 and stacker 12, therefore, represent generally any suitable printing device (e.g., printers, copiers, and multi-function peripherals) and associated post print finishing device in which imaging material is used to bind a printed documented.

Figure 1:
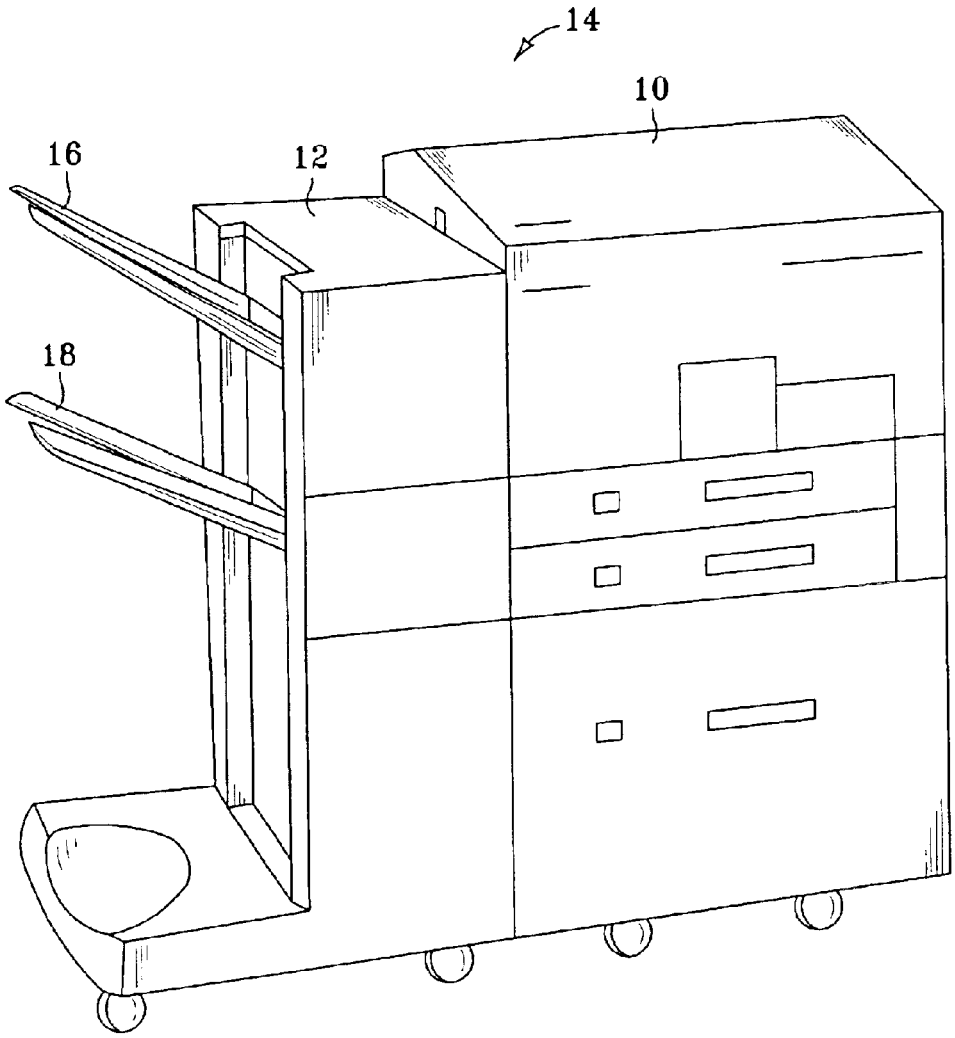
FIG. 1 is a perspective view of a printer and attached stacker illustrating one type of document printing and finishing system in which the invention may be implemented.

Referring to FIG. 1, printer 10 and stacker 12 together make up a document production system designated generally by reference number 14. Printed sheets are output by printer 10 to stacker 12 where they are routed to an upper/loose sheet output bin 16 or to a lower/stacker output bin 18. Unbound sheets are collected face up in loose sheet bin 16. Bound documents are collected face down in stacker bin 18.

Figure 2:
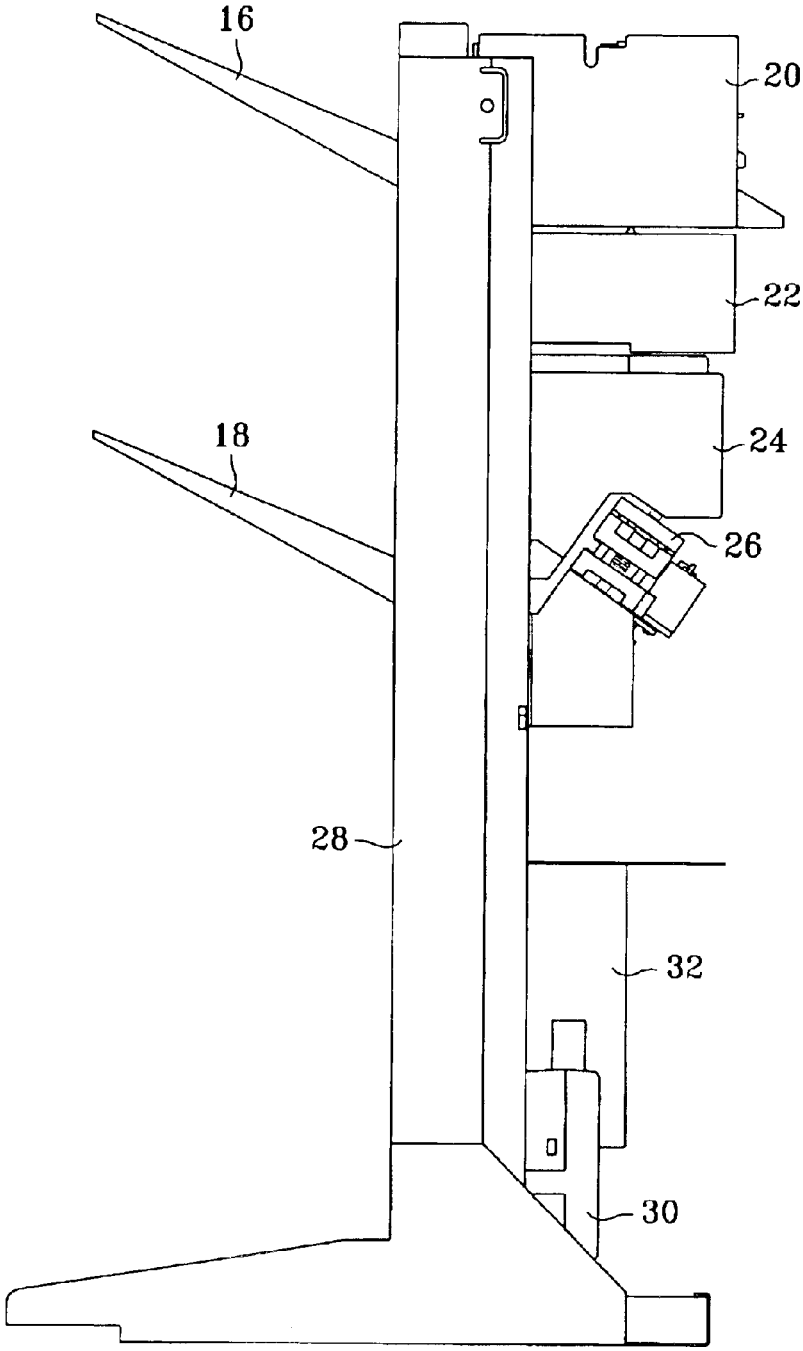
FIG. 2 is a side elevation view of a modular stacker constructed according to one embodiment of the invention showing the flipper, paper path, accumulator and binder modules.

A stacker 12 constructed according to one embodiment of the invention will now be described with reference to FIG. 2. FIG. 2 is a side elevation view looking into stacker 12 showing the flipper module 20, paper path module 22, accumulator module 24 and binder module 26. Each module is mounted to a frame 28. Frame 28, which forms the main body or "skeleton" of stacker 12, is made from sheet metal or other suitable structurally stable materials. A power supply 30 and controller 32 are mounted to the lower portion of frame 28. Power supply 30 and controller 32 are electrically connected to the operative components of modules 20, 22, 24 and 26. Controller 32 contains the electronic circuitry and programming necessary to control and coordinate various functions of the components in stacker 12. The details of the circuitry and programming of controller 32 are not particularly important to the invention as long as the controller design is sufficient to direct the desired functions as described below.

The modular design of stacker 12 shown in FIG. 2 is adapted from the Hewlett-Packard Company model C8085A stapler/stacker. Each module 20, 22, 24 and 26 is operatively coupled to but otherwise independent of the adjacent module. In the stacker of the present invention, the stapler module used in the C8085A stapler/stacker is replaced with binder module 26 and controller 32 is modified accordingly to control the operation of an imaging material binder rather than a stapler.

For sheets that will be stacked, bound and output to bin 18, flipper 20 makes the leading edge of each sheet output by printer 10 the trailing edge for routing to paper path 22 and accumulator 24. Flipping the sheets in this manner from face up to face down is necessary to properly stack the sheets in accumulator 24 prior to binding. Paper path 22 moves each sheet face down to accumulator 24 where the sheets are collected, registered, moved to binder 26 (when binding is desired) and then output to bin 18 (bound or unbound). Binder 26 reactivates the imaging material applied to select binding regions on sheets collected in accumulator 24 to bind the sheets together.

Figure 3:
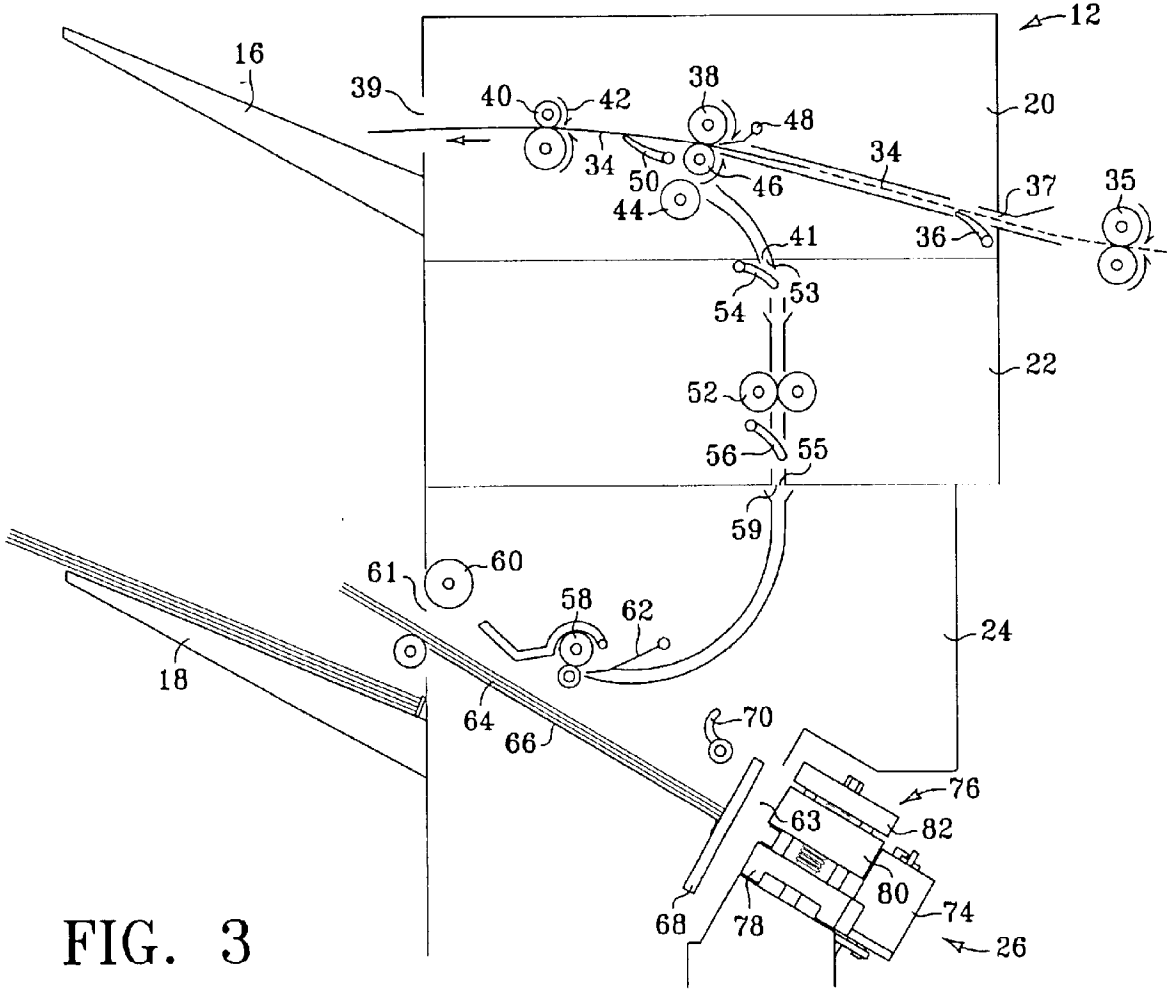
FIGS. 3–10 are side elevation views showing the routing of media sheets through the stacker of FIG. 2.
Figure 8:
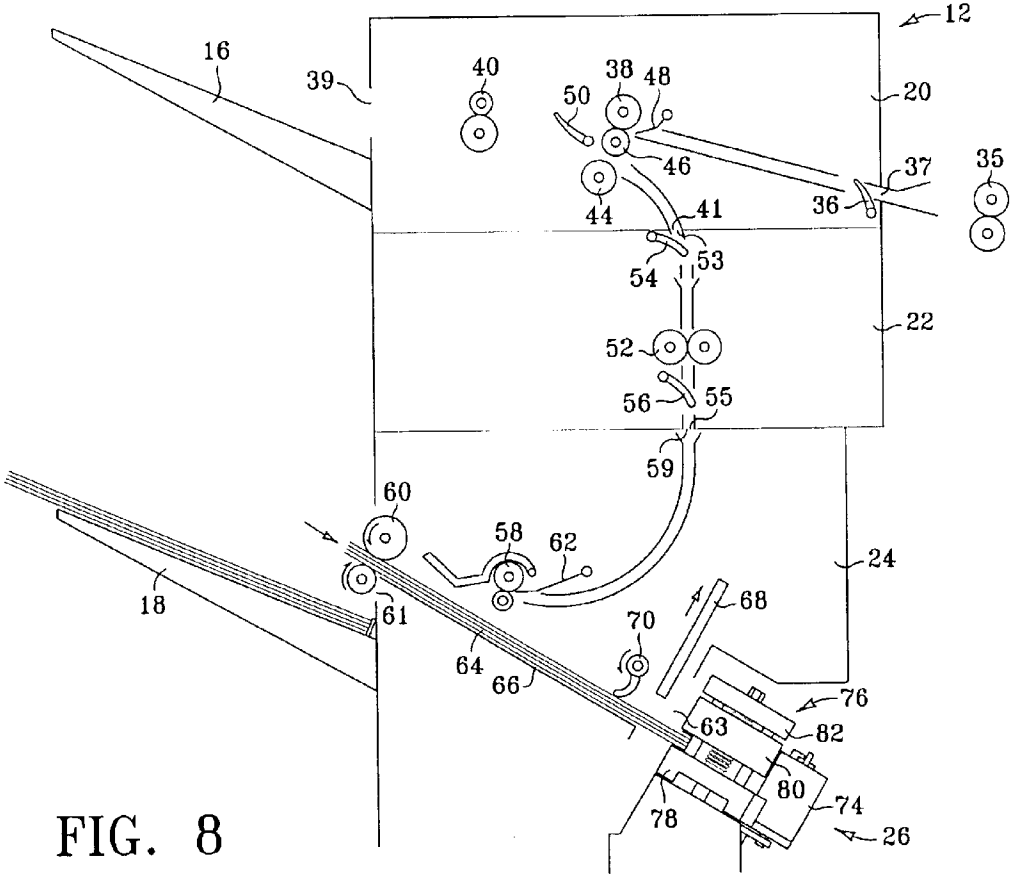
Figure 9:
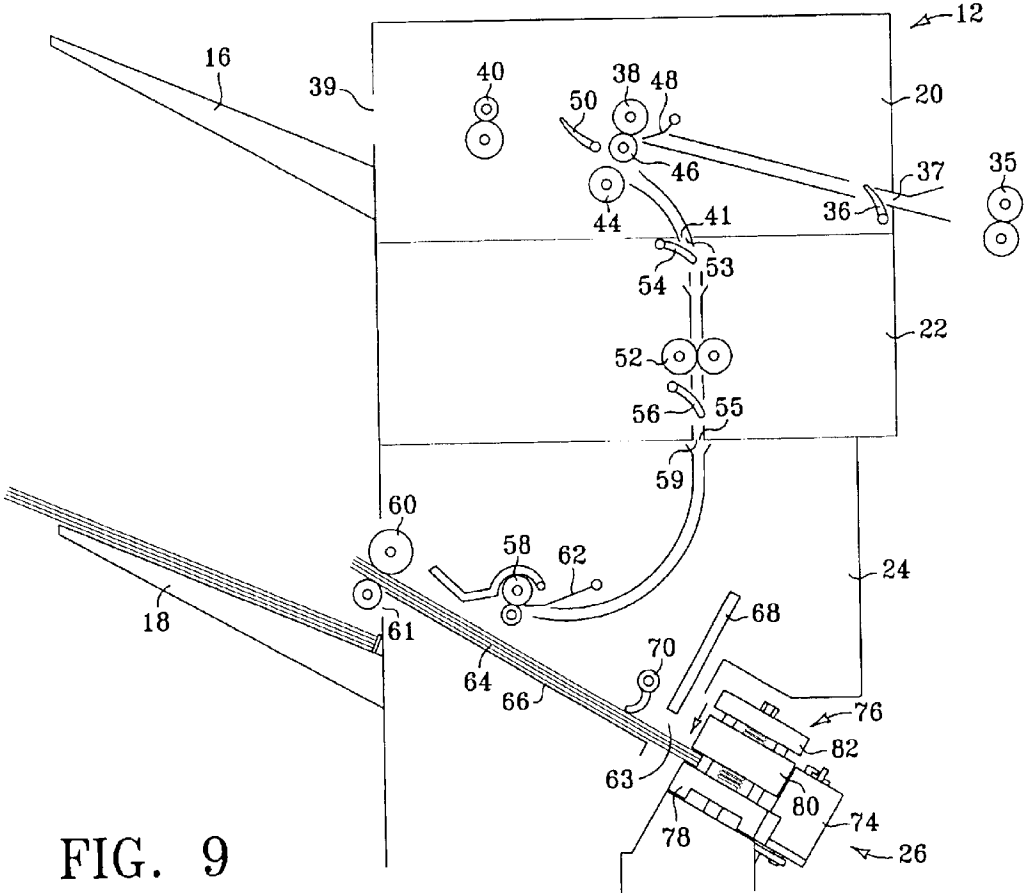
Figure 10:
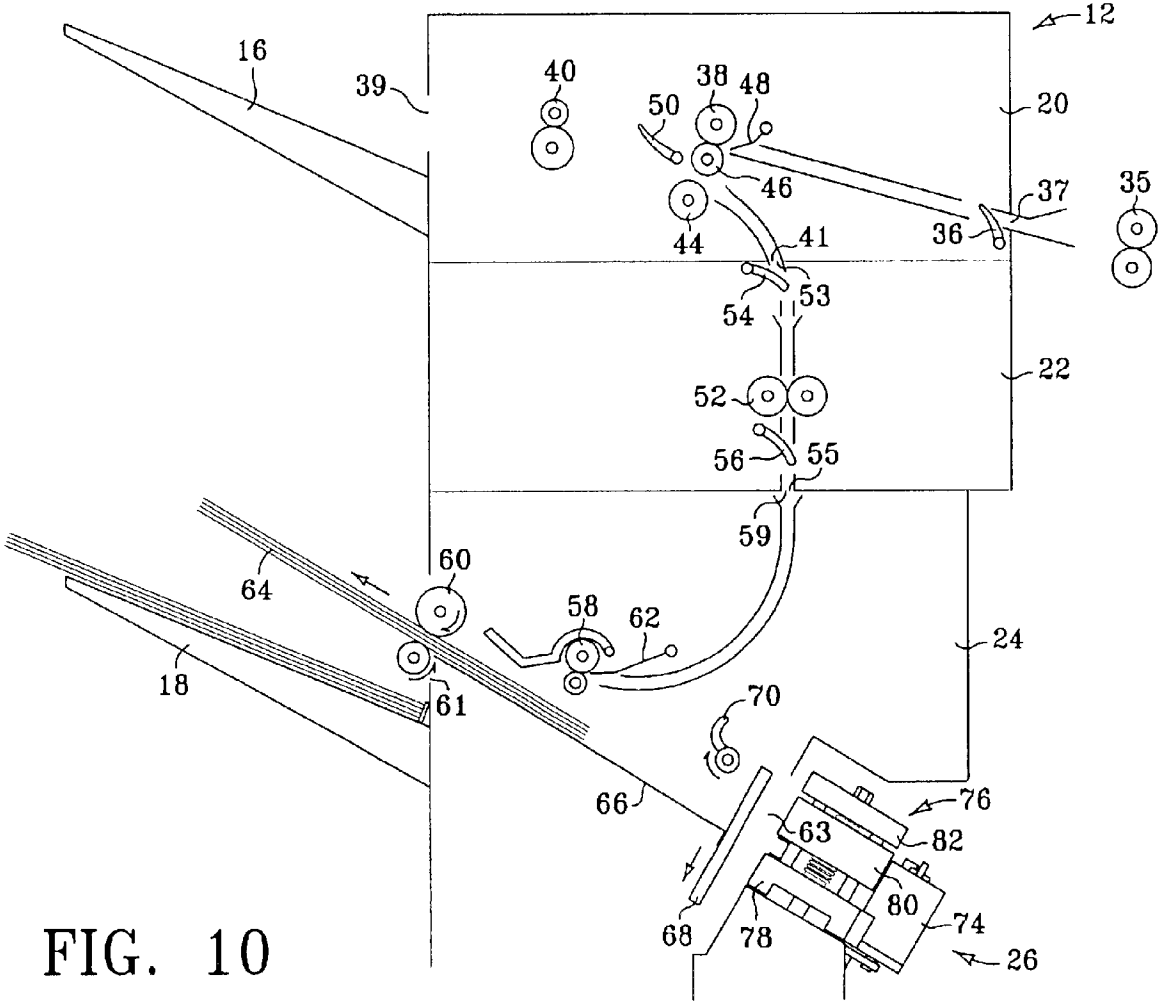

The operation of flipper 20, paper path 22, accumulator 24 and binder 26 will now be described in more detail with reference to FIGS. 3–10. FIG. 3 shows a sheet routed to loose sheet bin 16. FIGS. 4–7 show a sheet routed to accumulator 24 in preparation for binding. FIGS. 8–10 show the stack routed to binder 26, bound and then ejected to stacker bin 18.

Referring to FIG. 3, a sheet of paper or other print media 34 is output by printer 10 to stacker 12 through printer output rollers 35 and received into flipper 20 through flipper receiving port 37. As flipper entry sensor 36 detects sheet 34 entering flipper 20, flipper entry rollers 38 and flipper tray rollers 40 are driven forward as indicated by arrows 42 to move sheet 34 toward bin 16. For sheets routed to loose sheet bin 16 through flipper discharge port 39, rollers 38 and 40 are continually driven forward until sheet 34 reaches bin 16. In the embodiment shown in the Figures, flipper entry rollers 38 and flipper out rollers 44 share the same drive roller 46. Drive roller 46 is movable up or down to engage an opposing idler roller as necessary to move sheet 34 along one of two desired paper paths, as best seen by comparing FIGS. 3 and 4.

Figure 4:
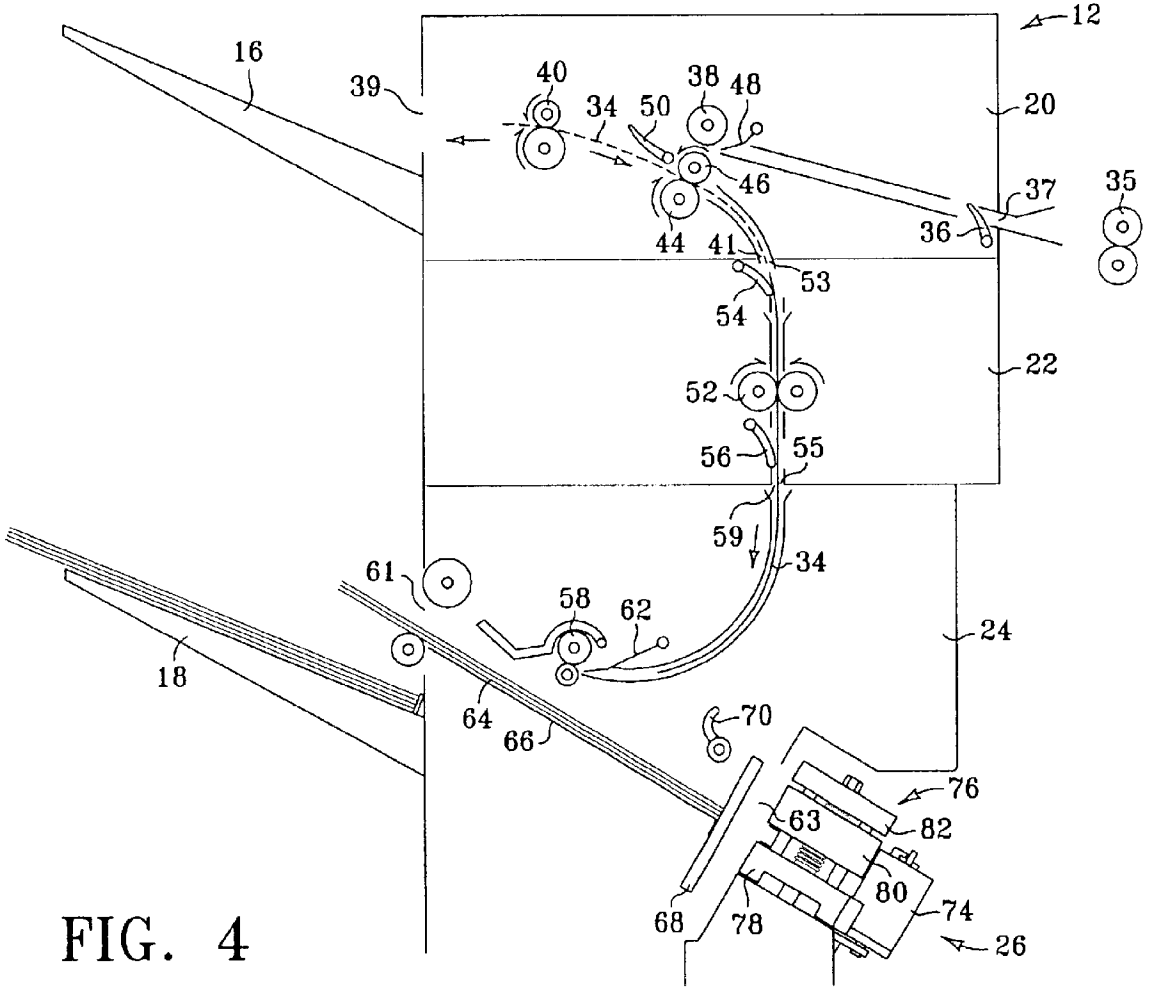

Referring now to FIG. 4, for sheets routed to accumulator 24, flipper entry and tray rollers 38 and 40 are driven forward until just after the trailing edge of sheet 34 clears flipper entry rollers 38, as detected by flipper middle sensor 48, such that the trailing edge of sheet 34 clears directional guide 50. Then, drive roller 46 is moved down to flipper out roller 44 and reversed along with flipper tray rollers 40 to route sheet 34 toward paper path 22 through flipper routing port 41 and paper path receiving port 53. Paper path rollers 52 move sheet 34 through paper path 22 down to accumulator 24. Flipper exit sensor 54 detects when sheet 34 has cleared the flipper module 20. Paper path exit sensor 56 detects when sheet 34 has cleared the paper path module 24 through paper path discharge port 55. Exit sensors 54 and 56 are used to control paper path rollers 52. When paper path exit sensor 56 detects that sheet 34 is leaving the paper path module 24, then paper path rollers 52 are stopped unless another sheet has cleared the flipper module 20 as detected by flipper exit sensor 54.

Figure 5:
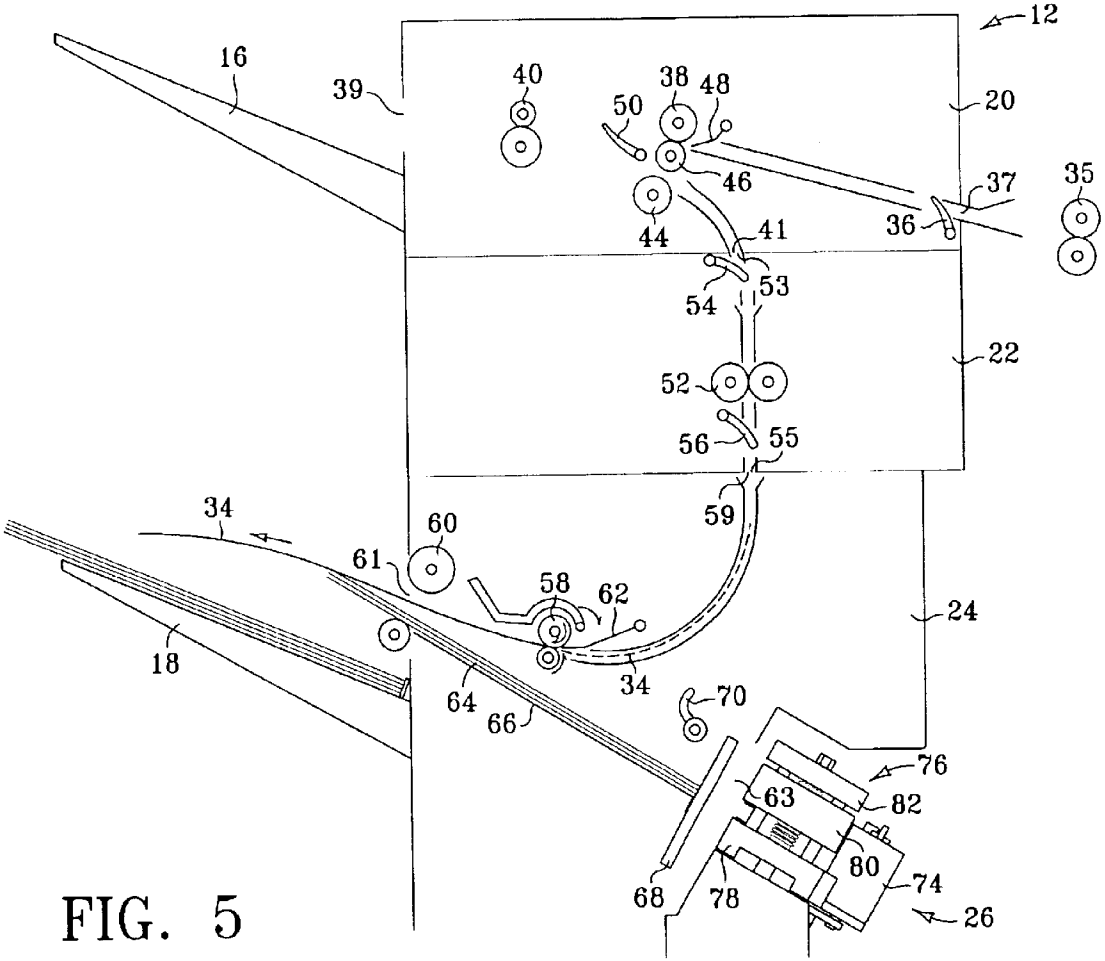
Figure 6:
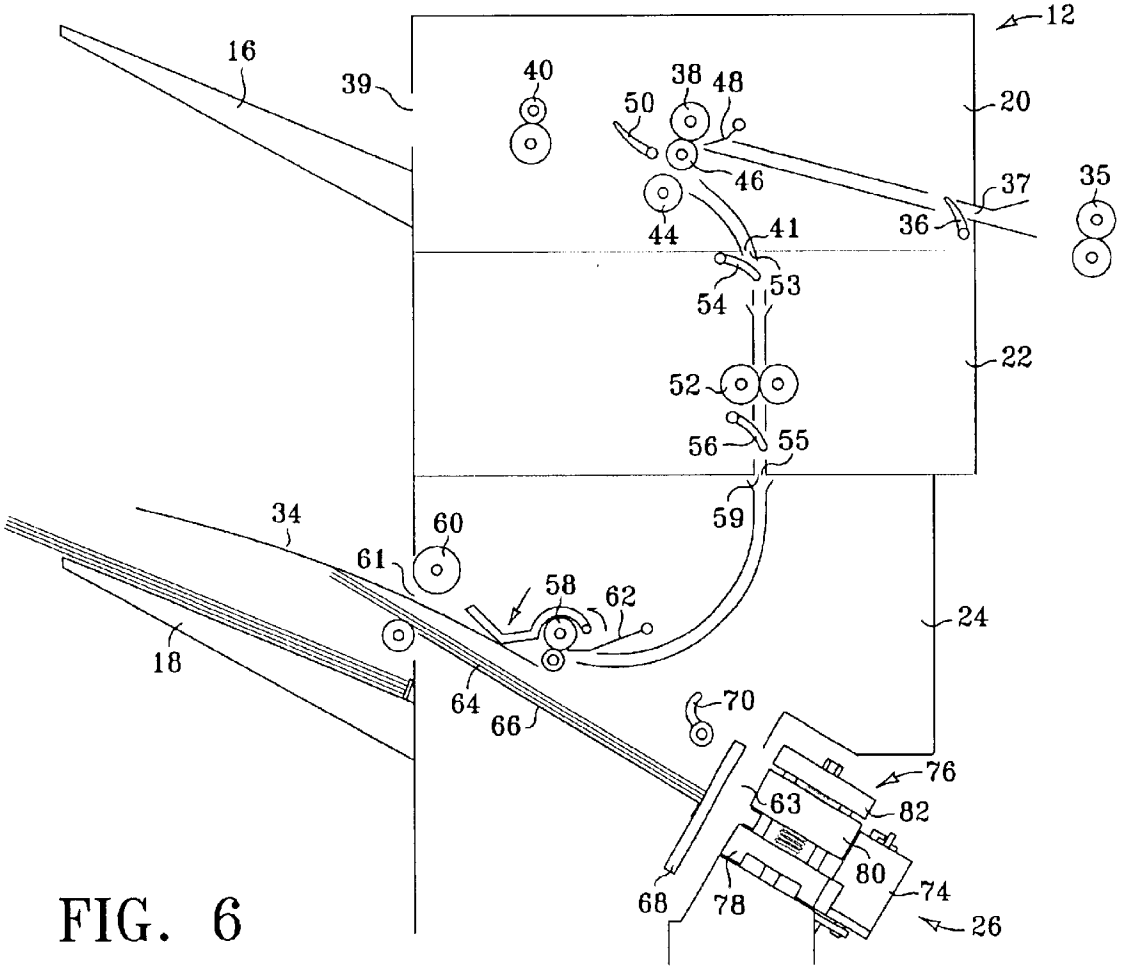
Figure 7:
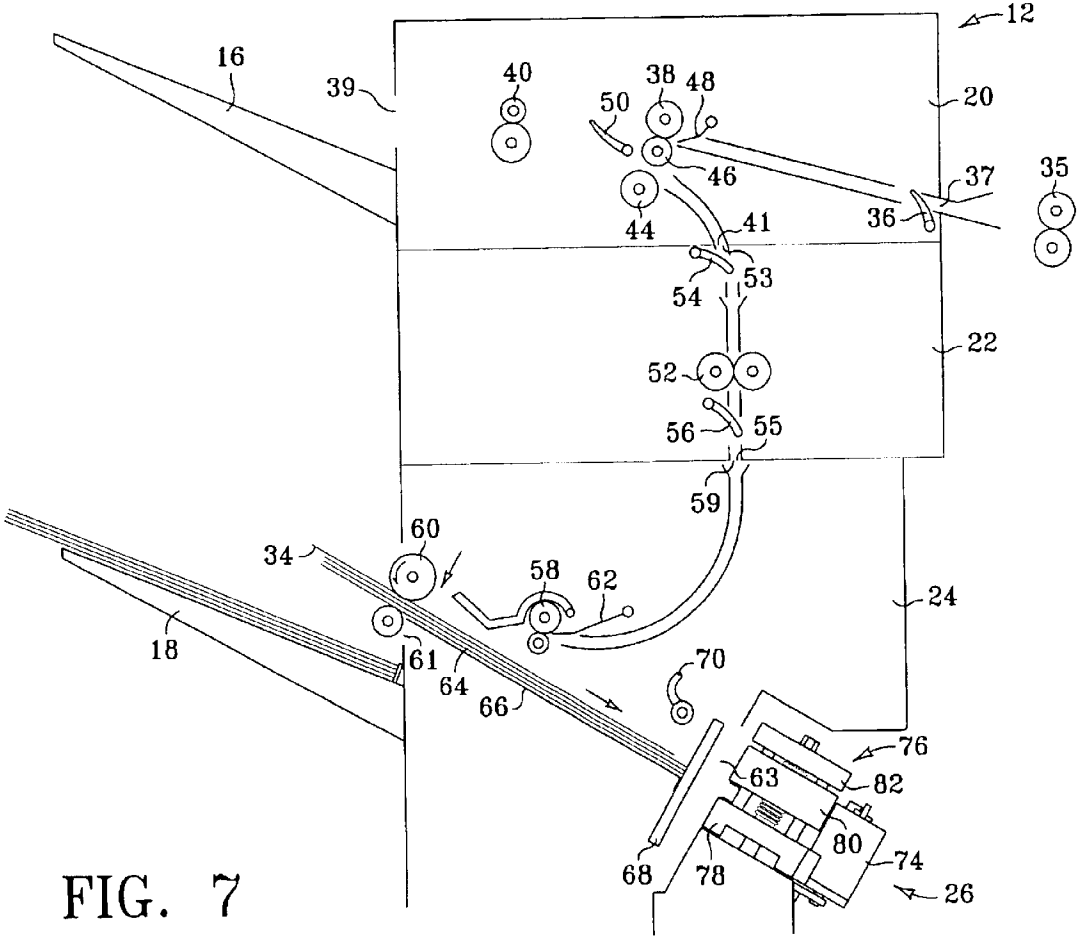

Referring to FIGS. 5–7, sheet 34 is guided down from accumulator receiving port 59 through accumulator 24 to accumulator entry rollers 58 and on to accumulator eject rollers 60. An accumulator entry sensor 62 is positioned immediately upstream from entry rollers 58. As the trailing edge of sheet 34 passes through entry rollers 58, as detected by entry sensor 62, eject rollers 60 move the top sheet 34 back on to stack 64 in accumulator holding tray 66, as best seen by comparing FIGS. 5, 6 and 7. In the embodiment shown in the Figures, eject rollers 60 are configured as a pair of variably spaced rollers that are selectively driven as necessary to move top sheet 34 or stack 64. As shown in FIGS. 5 and 6, eject rollers 60 are spaced apart or "open" to receive top sheet 34. Then, the rollers come together and the top roller is driven counterclockwise to move top sheet 34 on to stack 64, as shown in FIG. 7. Eject rollers 60 are driven together, as shown in FIGS. 8 and 10, counter-clockwise to move stack 64 into binder 76 (FIG. 8) or clockwise to move stack 64 into lower output bin 18 (FIG. 10). Although not shown, at the same time each sheet 34 is routed to holding tray 64, sheet 34 is aligned with the other sheets in stack 66.

A binding operation will now be described with reference to FIGS. 8–11. Referring to FIG. 8, once all the sheets in the document are accumulated in stack 64, eject rollers 60 draw stack 64 back slightly from registration wall 68, registration wall 68 is dropped and eject rollers 60 are reversed to move the edge of stack 64 forward into binder 26 through accumulator binding port 63. Retainer 70 is then lowered against stack 64 to hold stack 64 in position during binding.

Figure 11:
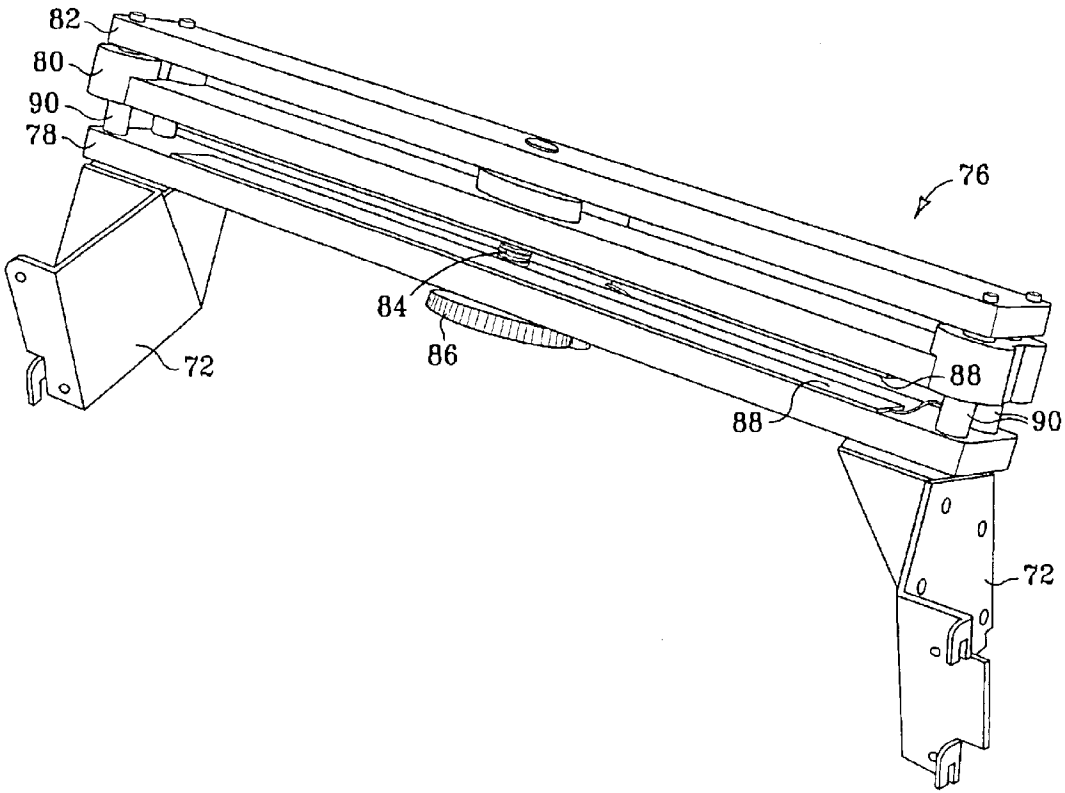
FIG. 11 is a detailed perspective view of the binder module of FIG. 2.

Referring now also to FIG. 11, binder 26 includes mounting brackets 72, reversible motor 74 (not shown in FIG. 11) and press 76. Press 76 includes base 78, carriage 80, top support plate 82, lead screw 84 and gear 86. Motor 74 is operatively connected to carriage 80 through gear 86 and lead screw 84. Carriage 80 moves alternately toward and away from base 78 along guide posts 90 at the urging of motor 74. Base 78 and carriage 80 are constructed as heated platens by, for example, applying resistive heating strips 88 along opposing surfaces of base 78 and carriage 80. Preferably, both platens (base 78 and carriage 80) are heated when all sheets in the stack are bound at the same time. Only the top platen (carriage 80) needs to be heated when each page or small numbers of pages are bound to the stack using page by page binding techniques such as those described in the '124 application referenced in the Background.

Base 78 and carriage 80, the binder platens, form an opening immediately adjacent to accumulator holding tray 66. Preferably, holding tray 66 and platens 78 and 80 are aligned at substantially the same angle to allow stack 64 to move easily into the opening between platens 78 and 80. Once the edge of stack 64 is positioned in binder 26, heating strips 88 are activated and motor 74 is energized to close press 76 by driving carriage 80 against stack 64 and base 78, as shown in FIG. 9. Heat and pressure are thereby applied to the imaging material applied by printer 10 to the binding region along the edge of the sheets in stack 64. Motor 74 is then reversed to open press 76 by driving carriage 80 away from stack 64 and base 78. Retainer 70 is raised off the now bound stack 64, ejector rollers 60 are reversed again to route the bound stack 64 through accumulator discharge port 61 to stacker bin 18, and registration wall 68 is raised in preparation for stacking the next print job, as shown in FIG. 10.

While the present invention has been shown and described with reference to the foregoing exemplary embodiment, it is to be understood that other forms, details, and embodiments may be made without departing from the spirit and scope of the invention which is defined in the following claims.

What is claimed is:

1. A post print finishing device, comprising:

an output bin;

a sheet accumulator disposed adjacent to the output bin, the accumulator having a receiving port through which sheets are received into the accumulator, a discharge port through which a stack of sheets is discharged to the output bin, and a binding part through which a stack of sheets is moved for binding, the accumulator configured to accumulate sheets in a stack, move the stack back and forth through the binding port and discharge the stack to the output bin through the discharge port; and a binder disposed adjacent to the accumulator, the binder comprising a pair of heated platens disposed opposite one another adjacent to the accumulator binding port, the platens movable between a first open position in which an edge of the stack of sheets in the accumulator may be inserted between the platens or withdrawn from between the platens and a second compressed positioned in which heat and pressure are applied to the edge of the stack.

2. The device of claim 1, wherein:

a stationary base comprises a first platen in the pair of heated platens;

a movable carriage comprises a second platen in the pair of heated platens; and the device further comprises a reversing motor operatively coupled to the carriage, the carriage movable between the first position and the second position at the urging of the motor.

3. A post print finishing device, comprising:

a support structure having a base and uprights extending vertically from the base;

a first output bin mounted to the uprights;

a second output bin mounted to the uprights below the first output bin;

a first module mounted to the uprights adjacent to the first output bin;

a second module mounted to the uprights below the first module;

the first module having a first media path through which media sheets are output to the first output bin and a second media path through which media sheets are output toward the second module;

the second module having a binder comprising a pair of heated platens and a press coupled to one or both platens, one or both platens movable at the urging of the press between a first position in which one or both platens are separated from media sheets presented by the second module and a second position in which the platens compress and heat the media sheets; and the press comprising a stationary base including a first platen in the pair of heated platens, a stationary plate, a movable carriage including a second platen in the pair of heated platens interposed between the base and the plate, and a lead screw extending from the base to the plate through the middle of the carriage, the lead screw threaded through the carriage such that rotation of the lead screw in a first direction moves the carriage toward the first position and rotation of the lead screw in a second direction opposite the first direction moves the carriage toward the second position.

4. The device of claim 3, wherein the first module comprises a flipper module operative to receive a sheet leading edge first, discharge a sheet leading edge first along the first media path to the first output bin and discharge the sheet trailing edge first along the second media path.

5. The device of claim 4, further comprising a third module mounted to the uprights between the first and second modules, the third module having a sheet accumulator configured to accumulate sheets in a stack, move the stack to and from the binder and discharge the stack to the output bin through the discharge port.

6. A document production system, comprising:

a printing device; and a post print finishing device operatively connected to the printing device, the finishing device comprising an output bin;

a sheet accumulator disposed adjacent to the output bin, the accumulator having a receiving port through which sheets are received into the accumulator, a discharge port through which a stack of sheets is discharged to the output bin, and a binding port through which a stack of sheets is moved for binding, the accumulator configured to accumulate sheets in a stack, move the stack back and forth through the binding port and discharge the stack to the output bin through the discharge port, and a binder disposed adjacent to the accumulator, the binder comprising a pair of heated platens disposed opposite one another adjacent to the accumulator binding port, the platens movable between a first open position in which an edge of the stack of sheets in the accumulator may be inserted between the platens or withdrawn from between the platens and a second compressed positioned in which heat and pressure are applied to the edge of the stack.

7. The system of claim 6, wherein:

a stationary base comprises a first platen in the pair of heated platens;

a movable carriage comprises a second platen in the pair of heated platens; and the device further comprises a reversing motor operatively coupled to the carriage, the carriage movable between the first position and the second position at the urging of the motor.

* * * * *